US008864250B2

(12) United States Patent
Anderson et al.

(10) Patent No.: US 8,864,250 B2
(45) Date of Patent: Oct. 21, 2014

(54) UNIVERSAL CRISPER FRAME ABLE TO ACCOMMODATE A VARIETY OF CRISPER CONFIGURATIONS

(75) Inventors: Troy M. Anderson, Marion, IA (US); Todd E. Jackson, North Liberty, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 289 days.

(21) Appl. No.: 12/627,456

(22) Filed: Nov. 30, 2009

(65) Prior Publication Data

US 2011/0127896 A1 Jun. 2, 2011

(51) Int. Cl.

| | |
|---|---|
| ***A47B 96/04*** | (2006.01) |
| ***A47B 88/00*** | (2006.01) |
| ***F25D 25/02*** | (2006.01) |
| *F25D 23/06* | (2006.01) |

(52) U.S. Cl.

CPC ..... *F25D 25/025* (2013.01); *F25D 2325/021* (2013.01); *F25D 23/067* (2013.01)

USPC ..... 312/404; 312/330.1

(58) Field of Classification Search

USPC ..... 312/404, 408, 330.1, 334.1, 334.7

See application file for complete search history.

(56) References Cited

U.S. PATENT DOCUMENTS

| | | | | | |
|---|---|---|---|---|---|
| 2,302,236 | A | * | 11/1942 | Mayne | 211/126.1 |
| 2,312,325 | A | | 3/1943 | Earle | |
| 2,319,470 | A | * | 5/1943 | Nobles | 211/153 |
| 2,425,232 | A | | 8/1947 | Earle | |
| 2,549,879 | A | * | 4/1951 | Amore | 312/406.2 |
| 3,169,813 | A | * | 2/1965 | Cannon et al. | 312/270.3 |
| 3,473,345 | A | * | 10/1969 | Pfeiffer et al. | 62/408 |
| 4,129,347 | A | | 12/1978 | Godtschalck | |
| 4,173,378 | A | * | 11/1979 | Hanson et al. | 312/296 |
| 4,334,715 | A | | 6/1982 | Schreiner | |
| 4,729,613 | A | * | 3/1988 | Tromble et al. | 312/270.3 |
| 4,735,470 | A | | 4/1988 | Falk | |
| 4,870,836 | A | * | 10/1989 | Pink | 62/382 |
| 4,960,308 | A | | 10/1990 | Donaghy | |
| 5,040,856 | A | * | 8/1991 | Wilkins et al. | 312/402 |
| 5,044,059 | A | | 9/1991 | De Giulio | |
| 5,044,704 | A | * | 9/1991 | Bussan et al. | 312/402 |

(Continued)

FOREIGN PATENT DOCUMENTS

KR 1020090121583 A * 11/2009 ..... F25D 25/00

*Primary Examiner* — Darnell Jayne
*Assistant Examiner* — Andrew Roersma

(57) ABSTRACT

A refrigerator which includes a refrigerator cabinet, a door attached to the refrigerator cabinet, a refrigerator drawer assembly disposed within the cabinet, the assembly including: (a) a refrigerator drawer body with a bottom and a plurality of upright walls operatively connected to the bottom; (b) a perimeter frame with front, back and opposite portions; (c) a support member having a first end, a second end, a bottom, a top, and a plurality of walls, the support member interchangeably connected to the front and back portions of the perimeter frame; and (d) a refrigerator drawer subassembly configured to support and allow for movement of the refrigerator drawer. A method for manufacturing a refrigerator with refrigerator drawer assembly includes providing a perimeter frame and a support member, connecting the support member to the perimeter frame to create a first position, disconnecting the support member from the perimeter to create a second position, selecting one of a plurality of refrigerator drawer bodies for insertion into the perimeter based on the position of the support member, and selecting one of a plurality of refrigerator drawer subassemblies for connection to the perimeter frame, support member, or refrigerator drawer body.

18 Claims, 8 Drawing Sheets

(56) References Cited

U.S. PATENT DOCUMENTS

| | | | | | |
|---|---|---|---|---|---|
| 5,403,084 | A | * | 4/1995 | Kane et al. | 312/408 |
| 5,470,144 | A | | 11/1995 | Wen | |
| 5,588,727 | A | * | 12/1996 | D'Agaro et al. | 312/283 |
| 5,785,402 | A | * | 7/1998 | DeLorenzo | 312/350 |
| 5,820,239 | A | * | 10/1998 | Christenson et al. | 312/334.23 |
| 5,918,959 | A | * | 7/1999 | Lee | 312/404 |
| 5,947,574 | A | | 9/1999 | Avendano | |
| 6,565,169 | B1 | * | 5/2003 | Moreno-Olguin et al. | 312/404 |
| 7,762,636 | B2 | * | 7/2010 | Veeser et al. | 312/330.1 |
| 2002/0180323 | A1 | * | 12/2002 | Atalla et al. | 312/408 |
| 2005/0156494 | A1 | * | 7/2005 | Bergmann et al. | 312/404 |
| 2006/0017360 | A1 | * | 1/2006 | Lyvers et al. | 312/404 |
| 2007/0096610 | A1 | * | 5/2007 | Filho et al. | 312/408 |
| 2007/0145873 | A1 | | 6/2007 | Clark | |

* cited by examiner

UNIVERSAL CRISPER FRAME ABLE TO ACCOMMODATE A VARIETY OF CRISPER CONFIGURATIONS

FIELD OF INVENTION

This invention relates generally to a consumer-type refrigerator, and more particularly to a refrigerator with a universal crisper frame able to accommodate a variety of crisper configurations.

BACKGROUND OF THE INVENTION

Consumer refrigerators such as might be found in a household typically include a fresh food compartment. The refrigerator is provided with an evaporator for maintaining the fresh food compartments at a temperature range of about 32-40 degrees Fahrenheit. However, it is desirable to create separate compartments within the fresh food compartment. These compartments are commonly known as crisper drawers and can be kept at a different temperate and/or humidity than the fresh food compartment to accommodate the storage requirements for certain food items, such as dairy products, meats, fruits, and vegetables. Crisper drawers are internal drawers which can only be accessed if the fresh food compartment door is already open. Some refrigerators include a full width pantry or crisper drawer which is also an internal storage compartment which can only be accessed if the fresh food compartment door is already open. What is needed is a refrigerator and a method of manufacturing a refrigerator which allows different configurations of crispers.

SUMMARY OF THE INVENTION

In one aspect, the present invention is directed towards a refrigerator that includes a refrigerator cabinet, a door attached to the refrigerator cabinet, and a refrigerator drawer assembly disposed within the cabinet, the assembly including: (a) a refrigerator drawer body with a bottom and a plurality of upright walls operatively connected to the bottom; (b) a perimeter frame with front, back and opposite portions; (c) a support member having a first end, a second end, a bottom, a top, and a plurality of walls, the support member interchangeably connected to the front and back portions of the perimeter frame; and (d) a refrigerator drawer subassembly configured to support and allow for movement of the refrigerator drawer. The support member is in a first position when connected to the perimeter frame and in a second position when disconnected from the perimeter frame. The refrigerator drawer body is chosen based on the position of the support member. A full width refrigerator drawer body is used when the support member is in the second position, while at least one half width refrigerator drawer body is used when the support member is in the first position. The refrigerator drawer subassembly being a sliding subassembly wherein the refrigerator drawer slidably engages a plurality of channels, a rolling subassembly wherein the refrigerator drawer engages a plurality of rollers, or a gliding subassembly wherein the refrigerator drawer engages a plurality of glides.

In another aspect of the invention, a method is provided for manufacturing a refrigerator with refrigerator drawer assembly including the steps of providing a perimeter frame and a support member, connecting the support member to the perimeter to create a first position, disconnecting the support member to the perimeter frame to create a second position, selecting one of a plurality of refrigerator drawer bodies for insertion into the perimeter based on the position of the support member, and selecting one of a plurality of refrigerator drawer subassemblies for connection to the perimeter frame, support member, or refrigerator drawer body.

The present invention addresses a number of problems including, but not limited to, the costs associated with manufacturing multiple features and appearances for crisper and pantry assemblies on the same platform and the limited ability to change the appearance and options of major interior components. In order to reduce manufacturing costs it is preferable to produce components which are common to many refrigerator models and then to accessorize these models with varying components to distinguish the models.

Therefore it is a primary object, feature, or advantage of the present invention to improve upon the state of the art.

It is a further object, feature, or advantage of the present invention to reduce costs associated with manufacturing a refrigerator drawer assembly with multiple features and appearances.

Another object, feature, or advantage of the present invention is to provide a universal crisper frame which is capable of accommodating a variety of crisper configurations.

Yet another object, feature, or advantage of the present invention is to provide a method for manufacturing a refrigerator with a refrigerator drawer assembly in which major interior components are customizable.

A still further object of the present invention is to reduce inventory of part numbers for the manufacturing floor and limit capital for injection molding tools.

One or more of these and/or other objects, features, and advantages of the present invention will become apparent from the specification and claims that follow. No single embodiment of the present invention need exhibit all of these objects, features, or advantages.

DETAILED DESCRIPTION OF THE PREFERRED EMBODIMENT

Figure 1:
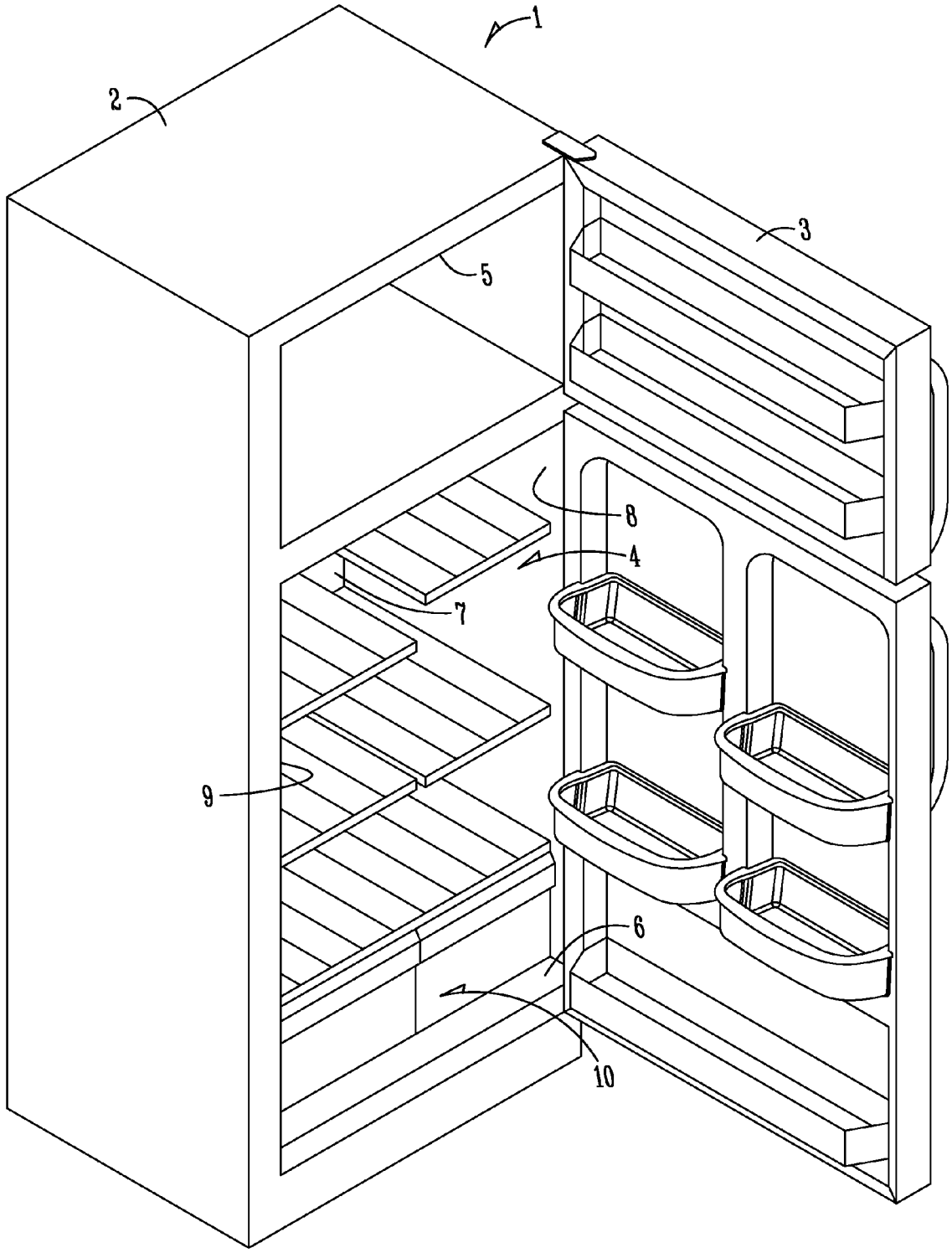
FIG. 1 is a perspective view of a refrigerator incorporating a refrigerator drawer body.
Figure 2:
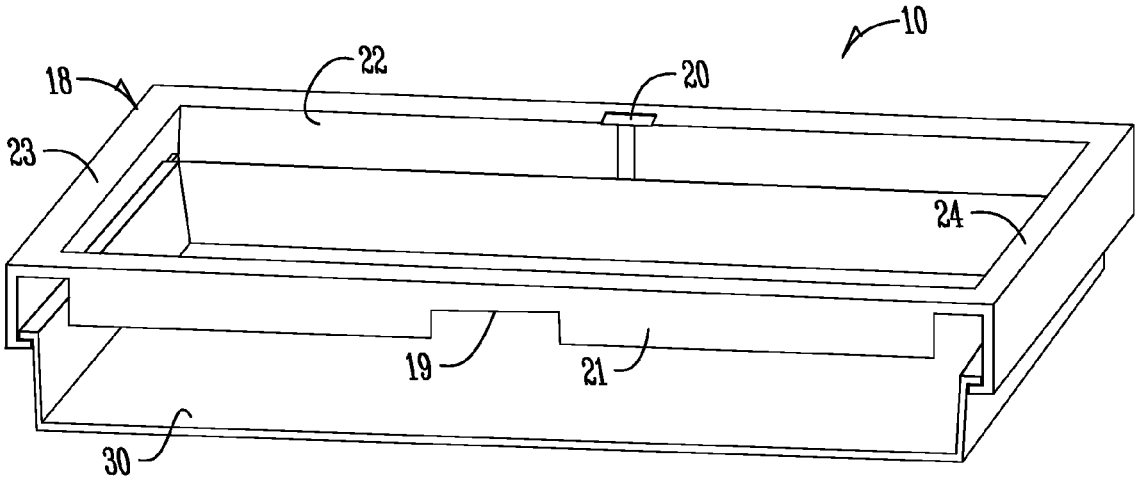
FIG. 2 is a perspective view of a full width refrigerator drawer body and a half width refrigerator drawer body.
Figure 2:
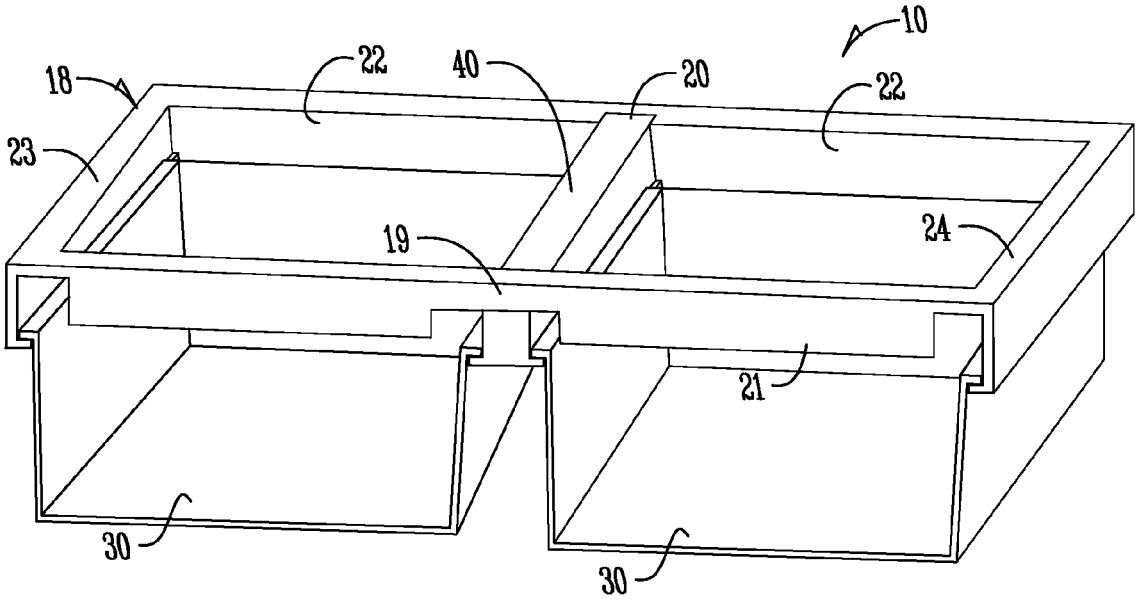

With respect to FIGS. 1 and 2, two exemplary embodiments of the present invention are shown which provide for significant advantages and benefits. Refrigerator 1 is shown to include a refrigerator cabinet 2. The cabinet includes top 5, bottom 6, rear 7 and opposing sidewalls 8, 9 which define a fresh food compartment 4. In addition, refrigerator 1 is shown to include a door 3 which is configured to close a fresh food compartment 4. Within the cabinet 2 is disposed a refrigerator drawer assembly 10. As shown in FIG. 2, the refrigerator drawer assembly 10 includes a perimeter frame 18 having front 21, back 22 and side portions 23, 24. The perimeter frame 18 is adapted to fit between rear wall 7 and opposing sidewalls 8, 9. The perimeter frame 18 has a front snap receiver 19 and a rear snap receiver 20 for interchangeably connecting support member 40 to the perimeter frame 18 when in a second position (FIG. 2; discussed below). The perimeter frame 18 may also be adapted to support a shelf. The exemplary embodiment of FIG. 2 further shows a refrigerator drawer body 30 with a bottom and plurality of upright walls operatively connected to the bottom. In first exemplary embodiment of FIG. 2, the refrigerator drawer body 30 is a full width drawer body, that is, the drawer body is approximately the full width of the perimeter frame 18. A second exemplary embodiment is shown in FIG. 2 wherein the refrigerator drawer body 30 is a half width drawer body with a bottom and a plurality of upright walls operatively connected to the bottom. In this embodiment, the refrigerator drawer body 30 is approximately half the width of the perimeter frame. Moreover, perimeter frame 18 and refrigerator drawer body 30 can be configured to move relative to perimeter frame 18 using a variety of subassemblies such gliding, sliding or rolling. As will be discussed below, and as can be appreciated by a skilled artisan, the present invention contemplates configuring a plurality of refrigerator drawer bodies of varying widths to move in several distinct ways to accommodate fresh food storage needs without substantially altering the refrigerator drawer assembly 10.

Figure 3:
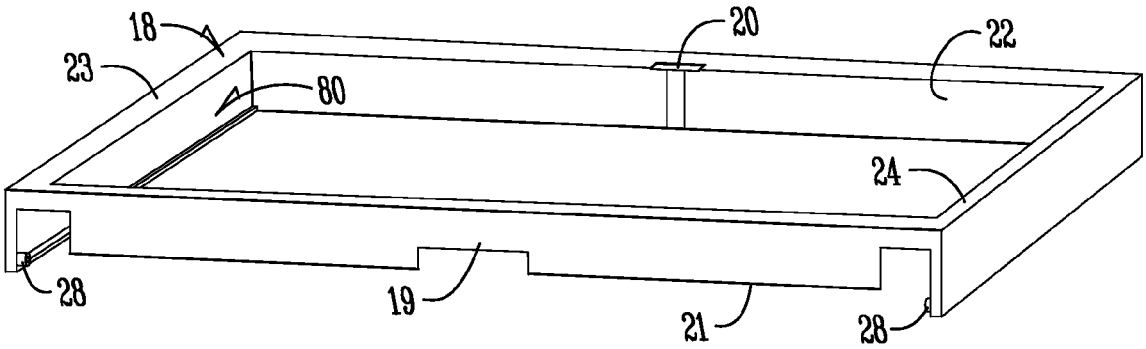
FIG. 3 is a perspective view of the perimeter frame configured for a full width refrigerator drawer body and a sliding subassembly.
Figure 3A:
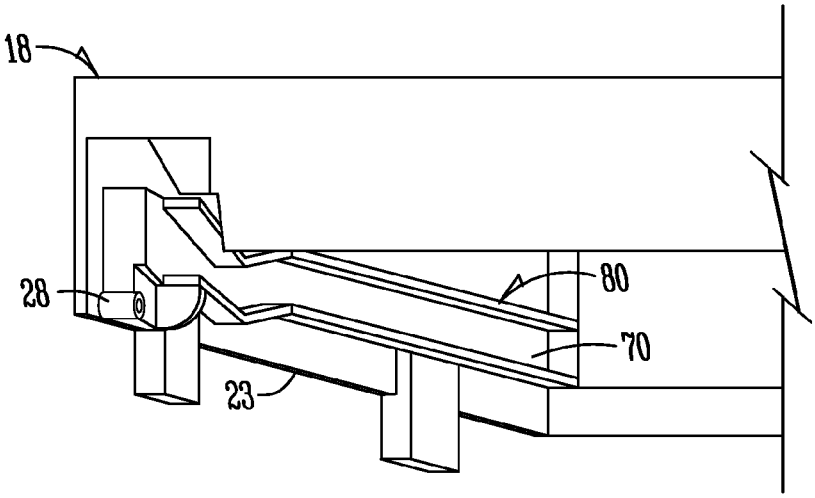
FIG. 3A is an enlarged perspective view of a front corner of the perimeter frame configured for a full width refrigerator drawer body and a sliding subassembly.
Figure 4:
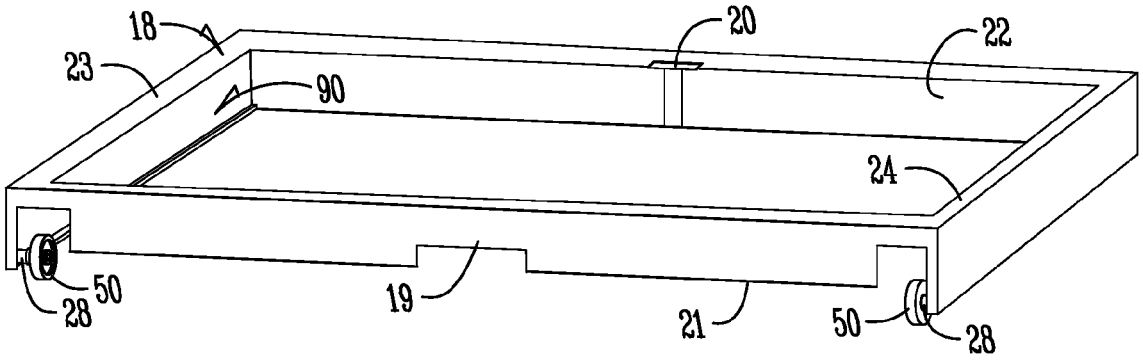
FIG. 4 is a perspective view of the perimeter frame configured for a full width refrigerator drawer body and a rolling subassembly.
Figure 4A:
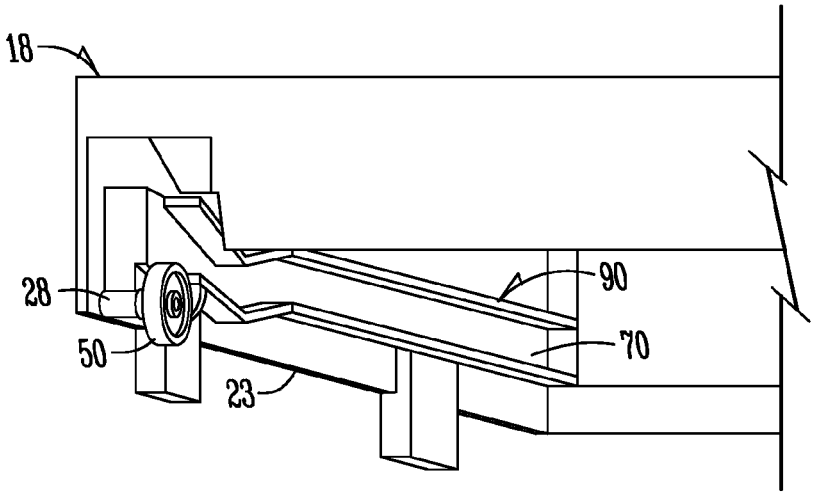
FIG. 4A is an enlarged perspective view of a front corner of the perimeter frame configured for a full width refrigerator drawer body and a rolling subassembly.

Now with reference to FIGS. 3-5A, a first exemplary embodiment of the present invention is shown. In this embodiment, refrigerator drawer assembly 10 utilizes a full width refrigerator drawer body 30. Support member 40 is in a second position and thus is not connected to the perimeter frame 18 at snap receivers 19 and 20. In FIG. 3, a perimeter frame 18 is shown configured to receive a full width refrigerator drawer body 30 and allow movement using a sliding refrigerator door subassembly 80. With this arrangement, the drawer body 30 is slidably supported by the perimeter frame 18 relative to front portion 21 and rear portion 22. As best shown in FIG. 3A, a channel 70 is disposed on side portion 23 and side portion 24 (not shown) to slidably receive the drawer body 30. The sliding subassembly 80 as shown will allow for plastic-on-plastic movement of the drawer body 30 with the perimeter frame 18. Moving to FIG. 4, perimeter frame 18 is configured to allow a full width refrigerator drawer body 30 to move using a rolling refrigerator door subassembly 90. With this arrangement, rollers 50 are connected to perimeter frame 18 at mount 28 and mounts disposed drawer body 30 (not shown) to rollably support the drawer body 30. As best show in FIG. 4A, rollers 50 are mounted to the perimeter frame 18 at mount 28. Thus, when inserted the drawer body 30 contacts the roller 50 and is received into channel 70. When the drawer body is withdrawn, a roller at mount 28 support a forward portion of the drawer body 30 while rollers mounted on the drawer body 30 (not shown) support a rearward portion of the drawer body 30. The combination of rollers 50 mounted on the perimeter frame 18 and drawer body 30 provide a continued rolling support when the drawer body 30 is both inserted and withdrawn.

Figure 5:
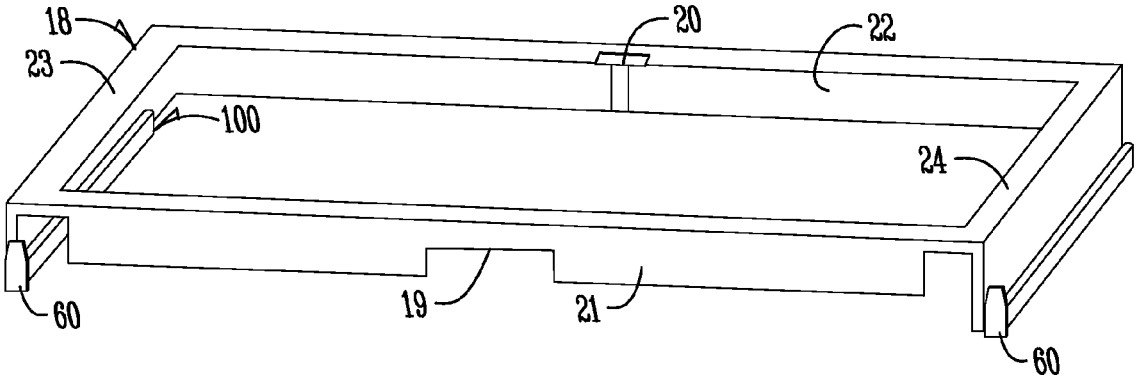
FIG. 5 is a perspective view of the perimeter frame configured for a full width refrigerator drawer body and a gliding subassembly.
Figure 5A:
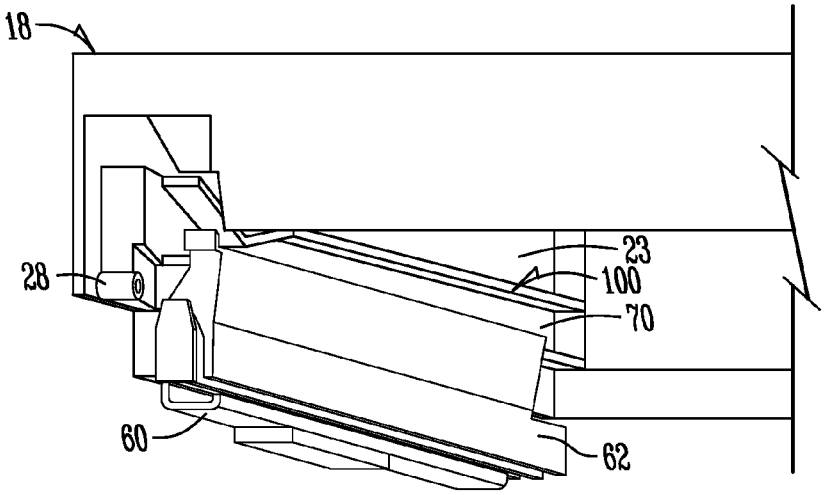
FIG. 5A is an enlarged perspective view of a front corner of the perimeter frame configured for a full width refrigerator drawer body and a gliding subassembly.

With respect to FIG. 5, perimeter frame 18 is configured to allow a full width refrigerator drawer body 30 to move using a gliding refrigerator door subassembly 100. With this arrangement, a standard under-the-drawer style gliding system is used to allow for movement of the drawer body 30 relative to the perimeter frame 18. The gliding subassembly 100 allows the drawer body 30 to be withdrawn entirely from the refrigerator 1 while still being supported by perimeter frame 18. As best shown in FIG. 5A, glide 60 may be mounted to the perimeter frame 18 with screws (not shown) or glide 60 may be snapped into the perimeter frame 18. An adaptor 62 is added to the glide 60 such that the drawer body can be mounted at the same level it would be if used the aforementioned sliding or rolling subassemblies. In this manner, the same drawer body can be used in each of the sliding, rolling, or gliding subassemblies.

Figure 6:
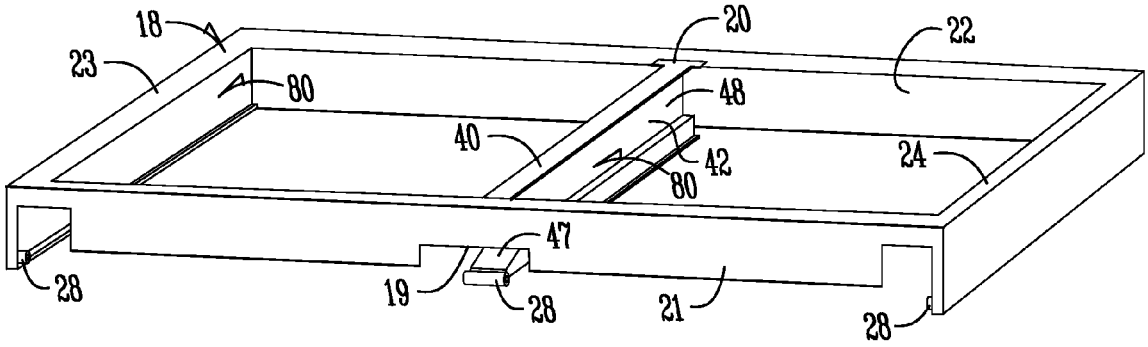
FIG. 6 is a perspective view of the perimeter frame and support member configured for a half width refrigerator drawer body and a sliding subassembly.
Figure 6A:
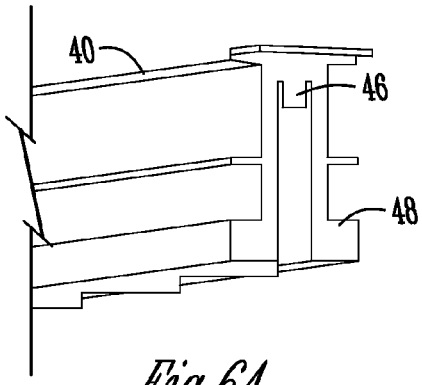
FIG. 6A is an enlarged perspective view of the second end of the support member.
Figure 6B:
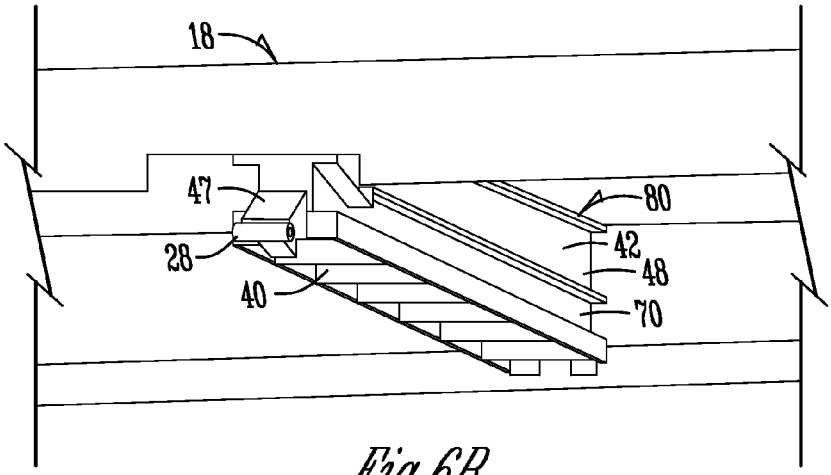
FIG. 6B is an enlarged perspective view of the perimeter frame and support member configured for a half width refrigerator drawer body and a sliding subassembly.
Figure 7:
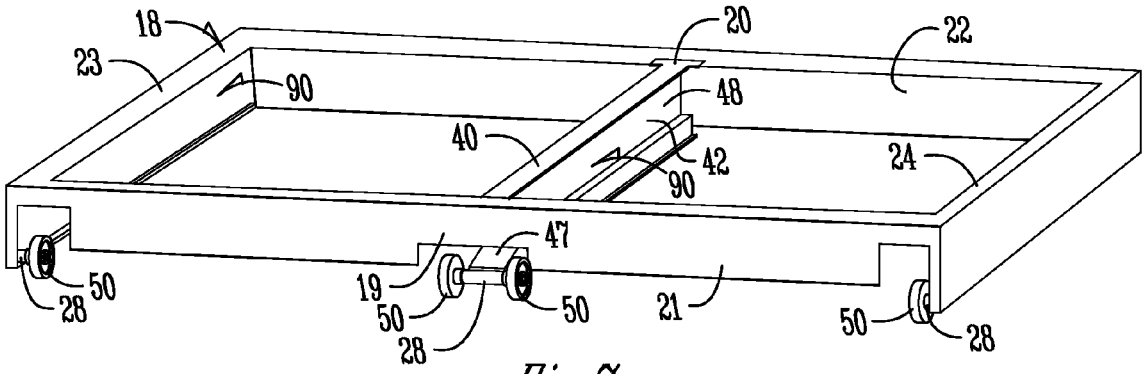
FIG. 7 is a perspective view of the perimeter frame and support member configured for a half width refrigerator drawer body and a rolling subassembly.
Figure 7A:
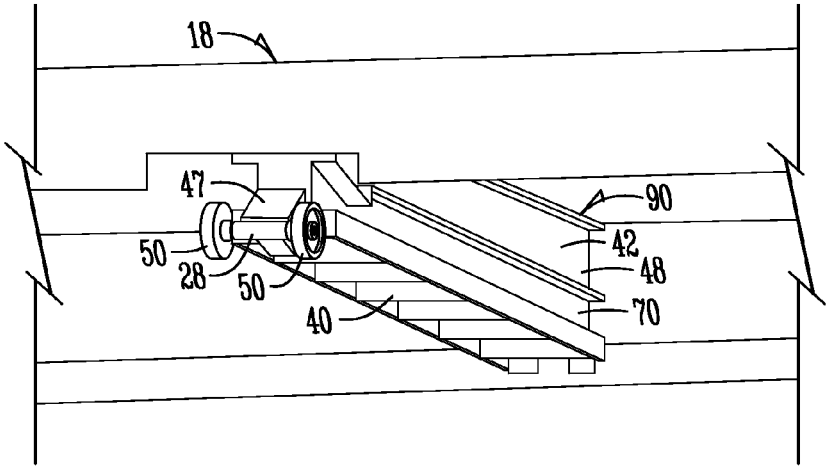
FIG. 7A is an enlarged perspective view of the perimeter frame and support member configured for a half width refrigerator drawer body and a rolling subassembly.

Reference now being given to FIGS. 6-8A, a second exemplary embodiment of the present invention is shown. In this embodiment, refrigerator drawer assembly 10 includes a one half width refrigerator drawer body 30. Support member 40 is in a first position and is connected to the perimeter frame 18 at snap receivers 19 and 20. In FIG. 6, perimeter frame 18 and support member 40 are configured to allow the drawer body 30 to move using a sliding refrigerator door subassembly 80. As shown in FIGS. 6A and 6B, support member 40 has a snap 46 on first end 47 and second end 48. In operation, a user snaps first end 47 and second end 48 of the support member 40 to a front snap receiver 19 and a rear snap receiver 20 disposed on the perimeter frame 18. As best shown in FIGS. 3A and 6B, a channel 70 is disposed on side portion 23 and 24 (not shown) of the perimeter frame 18 and on walls 42 of support member 40. With this arrangement, the drawer body 30 is slidably supported by the perimeter frame 18 and support member 40 to move relative to front portion 21 and rear portion 22 of the perimeter frame 18. The sliding subassembly 80 as shown will allow for plastic-on-plastic movement of the drawer body 30 with perimeter frame 18 and support member 40. Moving now to FIG. 7, perimeter frame 18 and support member 40 are configured to allow a half width refrigerator drawer body 30 to move using a rolling refrigerator door subassembly 90. As best show in FIGS. 4A and 7A, rollers 50 are mounted to the perimeter frame 18 at mount 28 and support member 40 at mount 44. With this arrangement, rollers 50 are connected to perimeter frame 18, support member 40, and drawer body 30 (not shown) to rollably supported the drawer body 30. Thus, when inserted the drawer body 30 contacts rollers 50 and is received into channel 70. When the drawer body is withdrawn, rollers at mount 28 and mount 44 support a forward portion of the drawer body 30 while rollers mounted on the drawer body 30 (not shown) support a rearward portion of the drawer body 30. The combination of rollers 50 mounted on the perimeter frame 18, support member 40 and drawer body 30 provide a continued rolling support when the drawer body 30 is both inserted and withdrawn.

Figure 8:
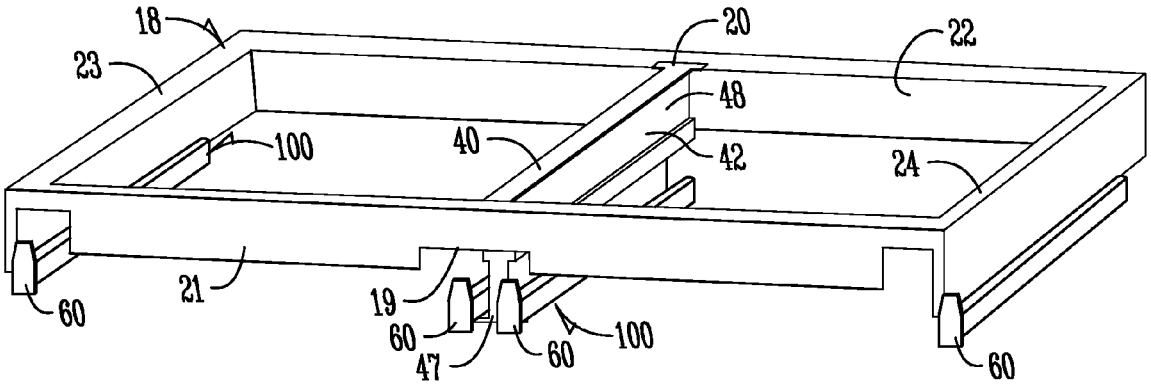
FIG. 8 is a perspective view of the perimeter frame and support member configured for a half width refrigerator drawer body and a gliding subassembly.
Figure 8A:
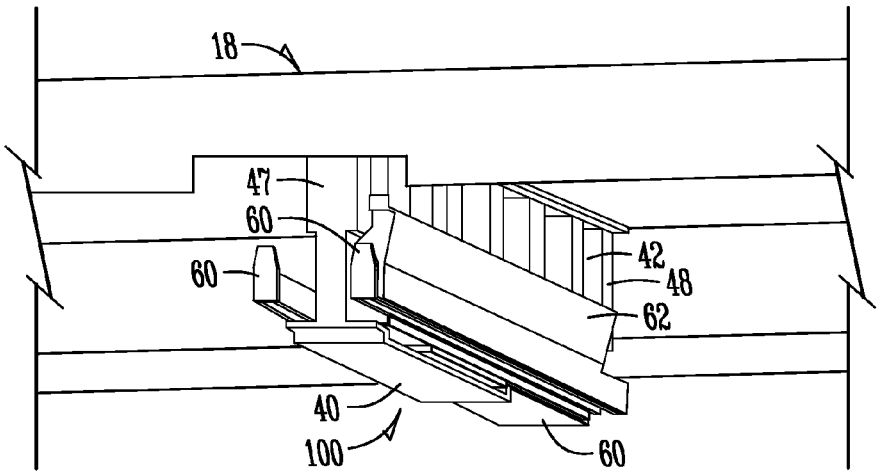
FIG. 8A is an enlarged perspective view of the perimeter frame and support member configured for a half width refrigerator drawer body and a gliding subassembly.

With respect to FIG. 8, perimeter frame 18 and support member 40 are configured to allow a full width refrigerator drawer body 30 to move using a gliding refrigerator door subassembly 100. With this arrangement, a standard under-the-drawer style gliding system is used to allow for movement of the drawer body 30 relative to the perimeter frame 18. The gliding subassembly 100 allows the drawer body 30 to be withdrawn entirely from the refrigerator 1 while still being supported by perimeter frame 18 and support member 40. As shown in FIG. 8A, a support member is provided to which a glide 60 may be snapped into or mounted to with screws (not shown). An adaptor 62 is further added to the support member 40 and glide 60 such that the drawer body can be mounted at the same level it would be if used the aforementioned sliding or rolling subassembly. In this manner, the same drawer body can be used in each of the sliding, rolling, or gliding subassemblies.

Further provided is a method for manufacturing a refrigerator with refrigerator drawer assembly including the steps of providing a perimeter frame and a support member, connecting the support member to the perimeter frame to create a first position, disconnecting the support member from the perimeter to create a second position, selecting one of a plurality of refrigerator drawer bodies for insertion into the perimeter based on the position of the support member, and selecting one of a plurality of refrigerator drawer subassemblies for connection to the perimeter frame, support member, or refrigerator drawer body. In operation, a support member is interchangeably connected or removed depending on the desired crisper configuration. If a full width drawer is desired, the support member is removed. If at least one half width drawer is desired, the support member is interchangeably connected to the perimeter frame. Moreover, gliding, sliding or rolling subassemblies can be interchangeably connected depending on the type of drawer movement desired.

Having thus described a preferred embodiment and other embodiments of a apparatus and method for a universal crisper frame able to accommodate a variety of crisper configurations, it should be apparent to those skilled in the art that certain advantages of the present invention have been achieved. It should also be appreciated that various modifications, adaptations, and alternatives may be made. It is of course not possible to describe every conceivable combination of components for purposes of describing the present invention. All such possible modifications are to be included within the spirit and scope of the present invention which is to be limited only by the following claims.

What is claimed is:

1. A refrigerator comprising:

a refrigerator cabinet;

a door attached to the refrigerator cabinet;

a refrigerator drawer assembly disposed within the cabinet, the assembly including: (a) a refrigerator drawer body with a bottom and a plurality of upright walls operatively connected to the bottom; (b) a perimeter frame with top, front, back and opposite side portions; (c) an integral front snap receiver centrally located on the front of the perimeter frame and an integral rear snap receiver centrally located on the back of the perimeter frame; (d) a support member having a first end, a second end, a bottom, a top, and a plurality of side walls, the support member interchangeably connected to the front and back portions of the perimeter frame at the integral front snap receiver and at the integral rear snap receiver; (e) a refrigerator drawer subassembly configured to support and allow for movement of the refrigerator drawer; and (f) a mount portion on the support member, the mount portion adapted to operate by itself to assist in providing a sliding drawer movement, removably attach to a rolling subassembly to assist in providing a rolling drawer movement, and removably attach to a gliding subassembly to assist in providing a gliding drawer movement; (g) a channel along the side walls of the support member configured for receiving drawer edges, the channel having a top ledge extending perpendicularly outward from one of the plurality of side walls between the first and second end, wherein a portion of the top ledge proximate the first end is concave shaped and extends into at least a portion of the channel; (h) the front of the perimeter frame having a front face extending between the opposite side portions and the top and an opposite bottom edge of the perimeter frame with a first notch proximate a first side of the perimeter frame and a second notch proximate an opposite second side of the perimeter frame, the first notch and the second notch extending in a vertical orientation from the opposite bottom edge toward the top of the perimeter frame for receiving drawer edges; and (i) a center notch in the front of the perimeter frame centered between the first notch and the second notch for receiving the support member; (j) a first downwardly extending front face portion between the first notch and the center notch and a second downwardly extending front face portion between the center notch and the second notch, the first and second downwardly extending front face portions terminating in the bottom edge of the perimeter frame; and the support member being in a first position when the support member is connected to the perimeter frame and being in a second position when the support member is disconnected from the perimeter frame.

2. The refrigerator according to claim 1 wherein the refrigerator drawer body is chosen based on the position of the support member.

3. The refrigerator drawer body according to claim 2 further comprising a one half width refrigerator drawer body when the support member is in the first position, wherein the one half width refrigerator drawer body is approximately half the width of the perimeter frame.

4. The refrigerator drawer body according to claim 2 further comprising a full width refrigerator drawer body when the support member is in the second position, wherein the full width refrigerator drawer body is approximately the full width of the perimeter frame.

5. The refrigerator according to claim 1 further comprising a refrigerator drawer subassembly having a sliding subassembly, wherein the refrigerator drawer slidably engages a plurality of channels.

6. The refrigerator according to claim 1 further comprising a refrigerator drawer subassembly having a rolling subassembly, wherein the refrigerator drawer engages a plurality of rollers.

7. The refrigerator according to claim 1 further comprising a refrigerator drawer subassembly having a gliding subassembly, wherein the refrigerator drawer engages a plurality of glides.

8. A refrigerator drawer assembly for storing fresh food within a refrigerator comprising:

a perimeter frame having front, back and opposite side portions, the front of the perimeter frame having a front face extending between the opposite side portions and a top and an opposite bottom edge of the perimeter frame with first and second notches near opposite ends of the front face for receiving drawer edges and a center notch therebetween receiving a support member, the first and second notches extending a vertical orientation from the opposite bottom edge toward the top of the perimeter frame for receiving drawer edges, a first downwardly extending front face portion between the first notch and the center notch and a second downwardly extending front face portion between the center notch and the second notch the first and second downwardly extending front face portions terminating in the opposite bottom edge of the perimeter frame;

an integral front snap receiver centrally located on the front of the perimeter frame and an integral rear snap receiver centrally located on the back of the perimeter frame;

the support member having a first end, a second end, a bottom, a top, and a plurality of walls, the support member being in a first position when connected to the perimeter frame at the integral front snap receiver and the integral rear snap receiver and being in a second position when disconnected from the perimeter frame;

a mount portion on the support member;

a channel along the side walls of the support member configured for receiving drawer edges, the channel having a top and bottom edge extending perpendicularly outward from one of the plurality of side walls and parallel to each other between the first and second end, wherein a portion of the top edge proximate the first end is concave shaped and extends into at least a portion of the channel, and wherein a roller mount is disposed on the side wall of the support member lower than the top edge of the channel;

at least one half width refrigerator drawer body, the at least one half width refrigerator drawer body being approximately half the width of the perimeter frame and having a bottom and a plurality of upright walls operatively connected to the bottom;

a full width refrigerator drawer body, the full width refrigerator drawer body being approximately the full width of the perimeter frame and having a bottom and a plurality of upright walls operatively connected to the bottom;

at least two subassemblies, a first of the at least two subassemblies providing one of a sliding, gliding, or rolling movement of a half width or a full width refrigerator drawer body relative to the perimeter frame, a second of the at least two subassemblies providing a different one of the sliding, gliding, or rolling movement of a half width or a full width refrigerator drawer body relative to the perimeter frame;

a full width refrigerator drawer body configuration with the support member in the second position, one of the at least two subassemblies connected to the perimeter frame, and a full width refrigerator drawer body installed on the frame;

a one half width refrigerator drawer body configuration with the support member in the first position, one of the at least two subassemblies connected to the perimeter frame and to the support member, and at least one half width refrigerator drawer body installed on the frame; and the refrigerator drawer assembly having the full width refrigerator drawer body configuration or the one half width refrigerator drawer body configuration.

9. The refrigerator drawer assembly according to claim 8 wherein the sliding movement of the one half width or full width refrigerator drawer body slidably engages a plurality of channels.

10. The refrigerator drawer assembly according to claim 8 wherein the rolling movement of the one half width or full width refrigerator drawer body engages a plurality of rollers.

11. The refrigerator drawer assembly according to claim 8 wherein the gliding movement of the one half width or full width refrigerator drawer body engages a plurality of glides.

12. A method for manufacturing a refrigerator with a refrigerator drawer assembly comprising:

providing a perimeter frame having top, front, back and opposite side portions and a support member having a mount portion, a first end, a second end, a bottom, a top, a plurality of side walls and a channel along the side walls of the support member configured for receiving drawer edges, the channel having a top ledge extending perpendicularly outward from one of the plurality of side walls between the first and second end, wherein a portion of the top ledge extends into at least a portion of the channel, the mount portion adapted to operate by itself to assist in providing a sliding drawer movement, removably attach to a roiling subassembly to assist in providing a rolling drawer movement, and removably attach to a gliding subassembly to assist in providing a gliding drawer movement, the perimeter frame having an integral front snap receiver and an integral rear snap receiver, both the integral front snap receiver and the integral rear snap receiver centrally located on the perimeter frame, the front of the perimeter frame having a front face spaced between the top, a bottom terminal edge and opposite side portions of the perimeter frame with first and second notches near opposite ends of the front face having a notch height extending from the bottom terminal edge toward the top of the perimeter frame in a generally vertical orientation for receiving drawer edges and a center notch therebetween for receiving the support member, the center notch extending from the bottom terminal edge toward the top of the perimeter frame in the generally vertical orientation wherein the center notch has a width to accommodate a pair of drawer edges and wherein the first and second notches have a width less than the width of the center notch to accommodate a single drawer edge wherein the front face includes a first downwardly extending front face portion between the first notch and the center notch and a second downwardly extending front face portion between the center notch and the second notch, the first and second downwardly extending front face portions terminating in a bottom edge, and wherein the notch height from the bottom edge is spaced between the center notch height and the top of the perimeter frame to accommodate drawer edges;

connecting the support member to the perimeter frame using the integral front snap receiver and the integral rear snap receiver to create a first position;

disconnecting the support member from the perimeter to create a second position;

selecting one of a plurality of refrigerator drawer bodies to provide a selected refrigerator drawer body having a bottom and a plurality of upright walls adapted for insertion into the perimeter based on the position of the support member;

selecting one of a plurality of refrigerator drawer subassemblies to provide a selected refrigerator drawer subassembly to interchangeably and removably connect to the perimeter frame, the mount portion of the support member, or refrigerator drawer body;

connecting the selected refrigerator drawer body to the selected refrigerator drawer subassembly;

inserting of the selected refrigerator drawer body into the perimeter frame.

13. The method according to claim 12 wherein the support member is interchangeably connected to the front and back portions of the perimeter frame.

14. The method according to claim 12 further comprising inserting a full width refrigerator drawer body into the perimeter frame when the support member is in a first position, wherein the full width refrigerator drawer body is approximately the full width of the perimeter frame.

15. The method according to claim 12 further comprising inserting a one half width refrigerator drawer body into the perimeter frame when the support member is in a second position, wherein the one half width refrigerator drawer body is approximately half the width of the perimeter frame.

16. The method according to claim 12 further comprising a refrigerator drawer subassembly having a sliding subassembly, wherein the refrigerator drawer slidably engages a plurality of channels.

17. The method according to claim 12 further comprising a refrigerator drawer subassembly having a rolling subassembly, wherein the refrigerator drawer engages a plurality of rollers.

18. The method according to claim 12 further comprising a refrigerator drawer subassembly having a gliding subassembly, wherein the refrigerator drawer engages a plurality of glides.

* * * * *